US006571421B1

(12) United States Patent
Sham et al.

(10) Patent No.: US 6,571,421 B1
(45) Date of Patent: Jun. 3, 2003

(54) VACUUM CLEANER AND STEAMER APPARATUS

(76) Inventors: John Chun Kuen Sham, 12/F., Kin Teck Industrial Bldg., 26 Wong Chuk Hang Road, Aberdeen (HK); Kumkit Kunavongvorakul, 889 Thai C.C. Tower, 18th Floor, Rm. 183 South Sathorn Road, Yannawa, Sathron Bangkok (TH), 10120

( * ) Notice: Subject to any disclaimer, the term of this patent is extended or adjusted under 35 U.S.C. 154(b) by 134 days.

(21) Appl. No.: 09/678,269

(22) Filed: Oct. 3, 2000

(51) Int. Cl.[7] ..... A47L 11/34
(52) U.S. Cl. ..... 15/320; 15/321
(58) Field of Search ..... 15/320, 321

(56) References Cited

U.S. PATENT DOCUMENTS

| | | | | | |
|---|---|---|---|---|---|
| 3,262,146 | A | * | 7/1966 | Hays | 15/321 |
| 3,755,850 | A | | 9/1973 | Porter | |
| 4,068,340 | A | | 1/1978 | Forward | |
| 4,327,459 | A | * | 5/1982 | Gilbert | 15/321 |
| 4,583,260 | A | | 4/1986 | Zai | |
| 4,896,396 | A | | 1/1990 | Giannelli | |
| 4,974,282 | A | * | 12/1990 | Stoltz et al. | 15/321 |
| 5,341,541 | A | | 8/1994 | Sham | |
| 5,386,612 | A | | 2/1995 | Sham | |
| 5,400,462 | A | * | 3/1995 | Amoretti | 15/321 |
| 5,473,792 | A | | 12/1995 | Kent et al. | |
| 5,502,872 | A | * | 4/1996 | Chae et al. | 15/320 |
| 5,513,415 | A | | 5/1996 | Kent et al. | |
| 5,613,271 | A | * | 3/1997 | Thomas | 15/321 |
| 5,784,755 | A | | 7/1998 | Karr et al. | |
| 5,819,364 | A | | 10/1998 | Sham | |
| 5,907,879 | A | | 6/1999 | Downey | |

* cited by examiner

*Primary Examiner*—Theresa T. Snider

(57) ABSTRACT

The vacuum cleaner and steamer apparatus of the present invention has a fluid assembly for generating and delivering true steam to a surface to be cleaned and a vacuum assembly for drawing deposited steam and other matter from the surface. The apparatus also includes a cleaning fluid reservoir for holding cleaning fluid and a waste reservoir for holding vacuumed matter. Preferably, both reservoirs are removable. Highly preferred embodiments have a housing 20 within which the cleaning fluid and waste reservoirs are received and retained. The fluid assembly preferably includes the cleaning fluid reservoir, a fluid pump for pumping cleaning fluid therefrom, a heater within which the cleaning fluid is turned into steam, and a sprayer head for spraying the steam upon the surface to be cleaned. The vacuum assembly preferably includes a vacuum fan driven by an electric motor, a vacuum head through which matter is drawn, and the waste reservoir. For improved maneuverability and control, the body assembly of the apparatus (including both reservoirs, the fan and motor, and preferably the fluid pump and heater) is preferably connected to a base assembly for movement with respect thereto. Preferably, the base assembly carries the vacuum and sprayer heads and a rotary brush driven by a dedicated electric motor. Highly preferred embodiments permit a user to control the amount of steam produced by the fluid assembly and indicate to the user via a humidity sensor and humidity indicator how dry a surface being vacuumed is.

32 Claims, 6 Drawing Sheets

VACUUM CLEANER AND STEAMER APPARATUS

FIELD OF THE INVENTION

This invention relates generally to dual purpose cleaning devices and methods, and more particularly to devices for vacuuming and steam cleaning and to methods of doing the same.

BACKGROUND OF THE INVENTION

Numerous cleaning devices exist that are capable of cleaning a surface (e.g. carpeting, tile flooring, and the like) using fluid and that are capable of vacuuming the fluid and other matter from the surface. For example, many conventional carpet cleaners operate by spraying or otherwise depositing cleaning fluid upon the carpet and then vacuuming up the cleaning fluid with dirt, dust, and other matter from the carpet. Whether for cleaning carpet or other surfaces, such cleaners typically employ hot water and cleaning agent as the cleaning fluid. In other cleaners, steam mixed with cleaning agent is used as the cleaning fluid.

Although cleaning devices capable of performing vacuuming and steaming operations upon a surface do exist, such devices are generally limited in their ability to perform both vacuuming and steam cleaning operations well. More particularly, conventional vacuum steam cleaning devices generally function poorly as vacuum cleaners, and often have steam cleaning functions limited by the inclusion of a vacuum cleaning system. Space and weight are almost always issues in the design of a cleaner having vacuum and steam cleaning capabilities. A more powerful vacuum cleaning system is typically heavier and takes up more space in the cleaner at the price of a smaller cleaning fluid reservoir and recovery tank reservoir and/or at the price of a bulky cleaner design. Similarly, larger reservoir and recovery tanks impact the ability to utilize a powerful vacuum cleaning system in the cleaner. As a result, conventional vacuum steam cleaners are often marketed and perceived by the consumer as a steam cleaner with vacuum recovery rather than as a dual purpose cleaner usable as a vacuum cleaner or as a steam cleaner.

A significant limitation in existing vacuum steam cleaners is the shape and size of these devices. Due at least in part to their dual (steam and vacuum) systems, many vacuum steam cleaners are very bulky and difficult to maneuver. In addition to the real or perceived difficulty in moving and controlling these devices, such cleaners are undesirable to consumers who wish to use the cleaner often as just a vacuum cleaner. While smaller vacuum steam cleaners can be easier to maneuver, a balanced cleaner design having powerful and effective steam and vacuum systems has not been achieved prior to the present invention.

Other limitations of conventional vacuum steam cleaners relates to their operational features. For example, full and easy access to cleaning fluid and waste (or "recovery") reservoirs is lacking in many existing vacuum steam cleaner designs. Commonly, one or both reservoirs is permanently mounted within the cleaner, complicating the process of filling the cleaning fluid reservoir and of emptying and cleaning the waste reservoir. As another example, many vacuum steam cleaners employ no device or element for scrubbing or agitating the surface being cleaned for better cleaning results. Those cleaners that do have such a device or element typically do not provide the user with the ability to adjust or control its operation. Also, conventional vacuum steam cleaners generally provide no control over the amount of steam produced by the cleaner during steam cleaning operations. The user therefore is incapable of adjusting the amount of cleaning fluid as a function of the type of surface being cleaned, the desired wetness of the cleaned surface, and the type of debris or stain being cleaned.

Another problem common to conventional vacuum steam cleaners is the inability of a user to readily detect the wetness of the surface (whether carpet, tile, wood, or otherwise) being cleaned. The ability to detect surface wetness can be important to a user desiring to limit the amount of cleaning fluid deposited upon the surface, for determining whether a surface has been sufficiently wetted during steaming operations, and for determining when a surface has been dried enough in vacuuming operations. A user of a conventional steam vacuum cleaner must rely upon the appearance or feel of the surface to determine how wet or dry the surface is—an unreliable and often inconvenient practice.

In light of the problems and limitations of the prior art described above, a need exists for a dual purpose cleaner capable of functioning as a vacuum cleaner and as a steam cleaner and which is easily maneuverable, is comparatively light, small, and streamlined relative to conventional vacuum steam cleaners, has cleaning fluid and waste reservoirs that are both removable from the cleaner, has a steam delivery rate that can be controlled by the user, has a cleaning device for scrubbing or agitating the surface being cleaned, and is capable of detecting the wetness of the surface being cleaned and of informing the user thereof. Each preferred embodiment of the present invention achieves one or more of these results.

SUMMARY OF THE INVENTION

The vacuum cleaner and steamer apparatus of the present invention has a fluid assembly for generating and delivering true steam (hot vapor as opposed to fluid mist) to a surface to be cleaned and a vacuum assembly for drawing deposited steam, other fluid, dust, dirt, and debris from the surface. The apparatus also includes a cleaning fluid reservoir to hold cleaning fluid for steam cleaning operations and a waste reservoir for holding the matter drawn into the vacuum assembly during vacuuming operations. Preferably, both reservoirs are received within dedicated recesses or receptacles within the apparatus and are removable for filling the cleaning fluid reservoir and for emptying the waste reservoir. Both reservoirs can and preferably do have doors for improved ability to fill and empty the cleaning fluid and waste reservoirs, respectively. Highly preferred embodiments of the present invention have a housing within which the cleaning fluid and waste reservoirs are at least partially received and retained (along with a number of other apparatus components).

The fluid assembly preferably includes the cleaning fluid reservoir, a fluid pump for pumping cleaning fluid from the cleaning fluid reservoir, a heater to which the cleaning fluid is pumped and within which the cleaning fluid is turned into steam, and a sprayer head for spraying the steam upon the surface to be cleaned. The vacuum assembly preferably includes a vacuum fan driven by an electric motor, a vacuum head through which matter is drawn by the vacuum fan, and the waste reservoir. For improved ability to manipulate and control the vacuum cleaner and steamer apparatus, the body assembly (including both reservoirs, the fan and motor, and preferably the fluid pump and heater) is preferably connected to a base assembly for movement with respect thereto. The base assembly preferably carries the vacuum and sprayer heads and, in some highly preferred embodiments, a surface agitator such as a rotary brush preferably driven by a dedicated electric motor. A preferably adjustable brush barrier can be employed to adjust the amount of brush that is exposed, such as for different floor types or for different cleaning operations. In some preferred embodiments, the body assembly is connected to the base assembly for pivotal movement with respect thereto, such as by a hinge joint or, more preferably, a ball and socket type joint. In either case, the joint is adapted to permit vacuum flow to be drawn therethrough in at least a range of body assembly positions relative to the base assembly.

Certain preferred embodiments of the present invention permit a user to switch between a steam cleaning mode and a vacuum cleaning mode by manipulating a switch connected to the fluid pump, heater, and fan motor. Highly preferred embodiments permit a user to control the amount of steam produced by the fluid assembly during steam cleaning operations. Specifically, the vacuum cleaner and steamer can be provided with a user-manipulatable control (such as a dial or knob) connected to the fluid pump for adjusting the operating speed of the fluid pump. By adjusting the fluid pump operating speed, the user can control the rate of cleaning fluid flow to the heater and therefore the rate of steam being produced and discharged from the fluid assembly.

In another preferred embodiment of the present invention, the vacuum cleaner and steamer can be provided with a humidity sensor to detect the moisture level of a surface being vacuumed. Whether vacuuming up cleaning fluid (deposited by the fluid assembly) or another fluid, the humidity sensor and an accompanying humidity indicator light informs a user when the surface being vacuumed is sufficiently dry. The humidity sensor is preferably located inside the vacuum assembly and more preferably is located immediately upstream of the waste reservoir exit.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
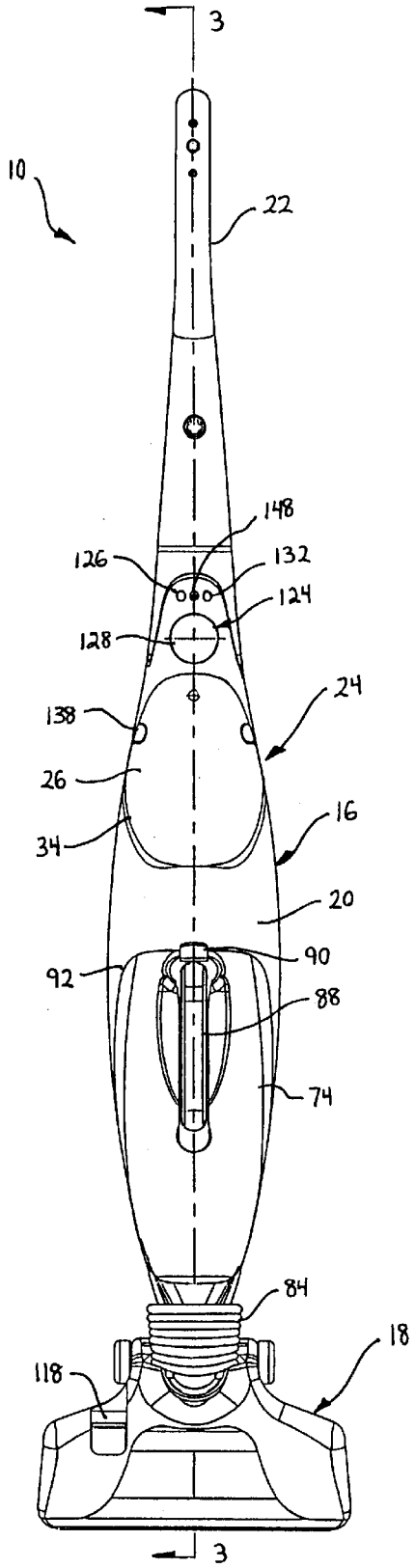
FIG. 1 is front view of a vacuum cleaner and steamer apparatus according to a preferred embodiment of the present invention.

With reference first to FIGS. 1–4, the vacuum cleaner and steamer of the present invention (indicated generally at 10) has a fluid assembly 12, a vacuum assembly 14, a body assembly 16, and a base assembly 18. As will be described in more detail below, the body assembly 16 is at least partially defined by components of the fluid and vacuum assemblies 12, 14.

Although not required, the body assembly 16 preferably includes a housing 20 within which components of the fluid and vacuum assemblies are at least partially received. In the illustrated preferred embodiment shown in the figures, the body assembly 16 has a handle portion 22 extending from an enclosure portion 24. The housing 20 is preferably an integral element manufactured in any conventional manner, such as by injection molding, casting, machining, stamping, and the like. Alternatively, the housing 20 can be defined by multiple elements connected together in any conventional manner, such as by welding, brazing, gluing, riveting, fastening (via threaded fasteners, nails, clamps, or other types of fasteners) snap-fitting, and the like. Preferably, the housing 20 is made from plastic, but can be made from any substantially rigid and resilient material, including without limitation steel, aluminum, or other metals, fiberglass, composites, or any combination thereof.

The handle portion 22 is preferably elongated with a streamlined profile for easy control and manipulation by a user. This handle shape can be slightly curved with an enlarged end as illustrated, but can take any shape desired, including without limitation looped, bent or angled, and T-shaped handles.

Figure 2:
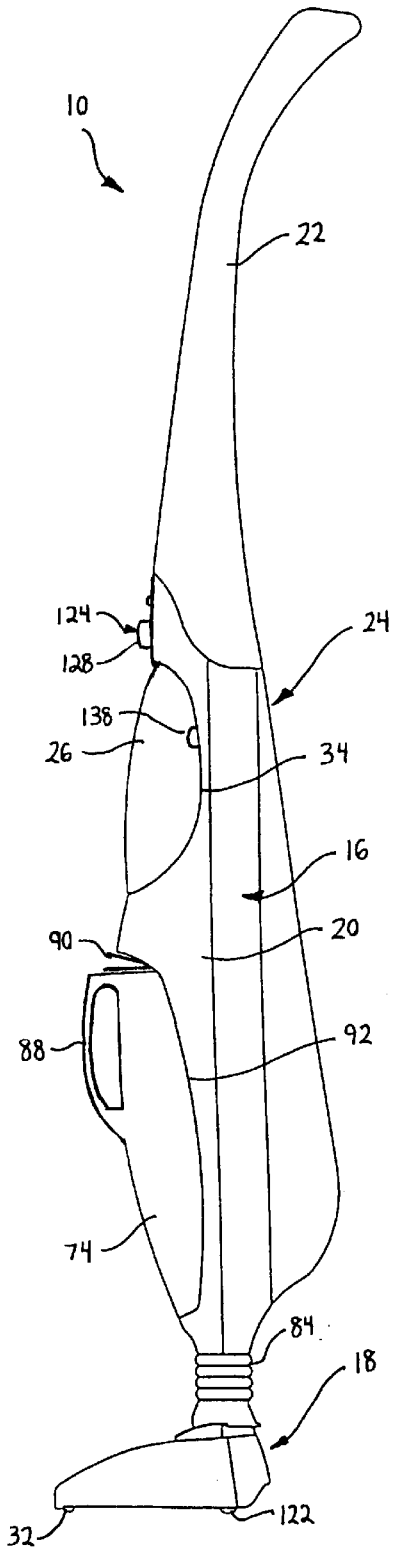
FIG. 2 is a side view of the vacuum cleaner and steamer apparatus illustrated in FIG. 1.
Figure 3:
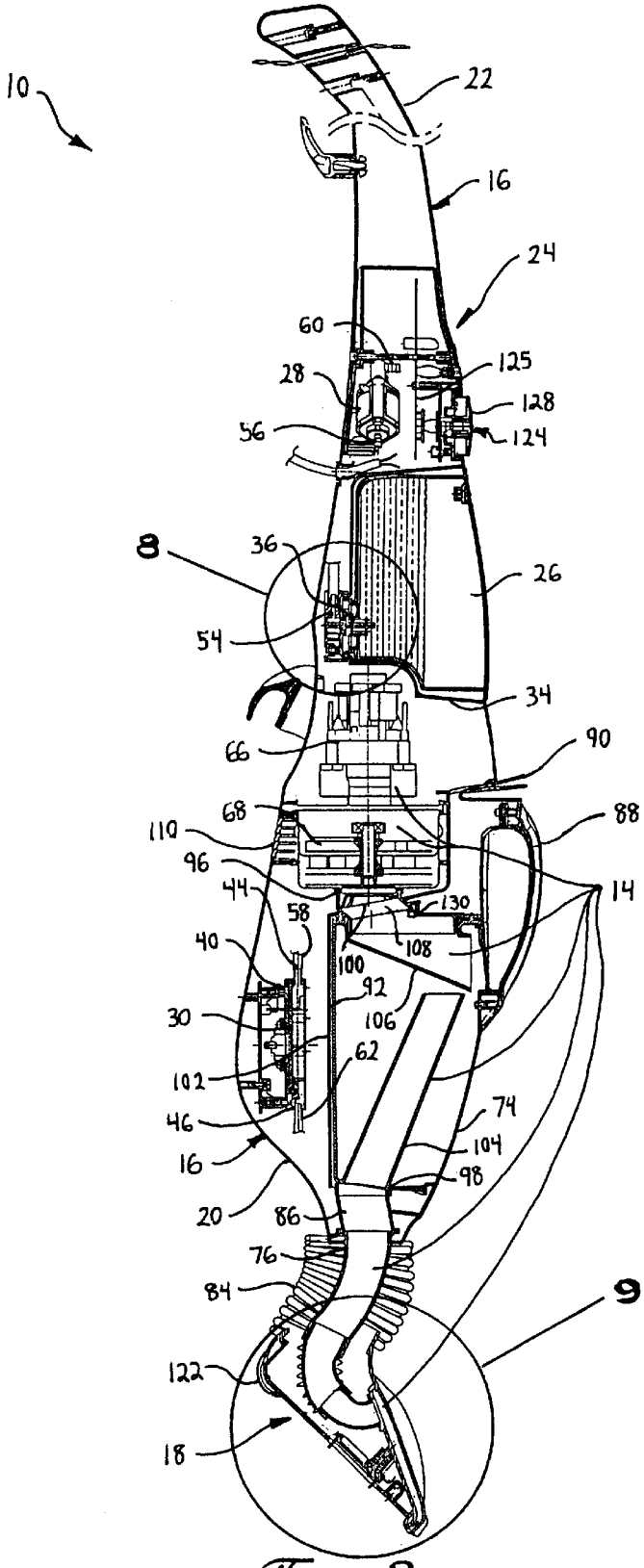
FIG. 3 is a cross sectional side view of the vacuum cleaner and steamer apparatus illustrated in FIGS. 1 and 2, taken along lines 3—3 in FIG. 1.
Figure 4:
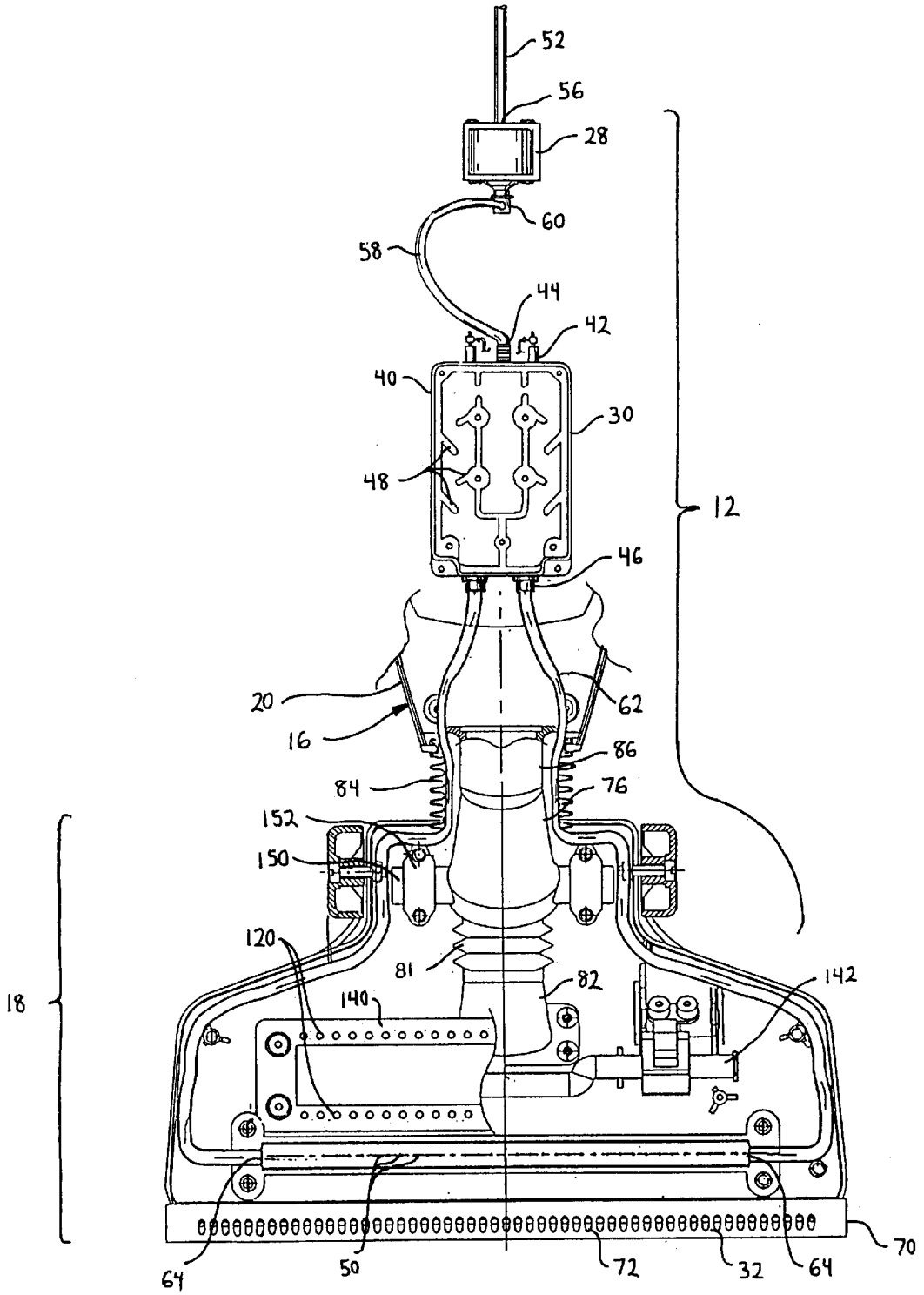
FIG. 4 is a detail view of the vacuum cleaner and steam apparatus illustrated in FIGS. 1–3, showing the fluid assembly in greater detail.

Referring now to FIGS. 3 and 4, the fluid assembly 12 preferably includes a cleaning fluid reservoir 26 within which can be stored cleaning fluid, a fluid pump 28 for pumping cleaning fluid out of the cleaning fluid reservoir 26, a heater 30 for heating cleaning fluid pumped from the cleaning fluid reservoir 26, and a sprayer head 32 for spraying steam discharged from the heater 30. The cleaning fluid reservoir 26 is preferably made of transparent or semi-transparent material such as plastic (or less preferably, glass), and is preferably removable from the housing 20. Alternatively, the cleaning fluid reservoir 26 can be made from any other rigid or substantially rigid material, including without limitation aluminum, steel, or other metal, fiberglass, composites, and the like. The cleaning fluid reservoir 26 can take any shape desired, such as round, square, rectangular, polygonal, or other shapes, and in each case is preferably received within a similarly shaped receptacle defined in the housing 20. For example, the cleaning fluid reservoir 26 illustrated in FIGS. 1–3 has an unusual shape matching a recess or receptacle 34 within the housing 20. While a matching reservoir and receptacle are not required, the cleaning fluid reservoir 26 is at least received in the housing 20 in a secure manner to be held therein after insertion. Also, the housing receptacle 34 for the cleaning fluid reservoir 26 can take the form of an externally-exposed recess as shown in the figures or can be partially or fully enclosed (e.g., by one or more doors or panels hinged or otherwise movable between an open position in which the cleaning fluid reservoir 26 can be removed from the housing 20 and a closed position in which the cleaning fluid reservoir 26 is retained within the housing 20).

To permit easy filling, the cleaning fluid reservoir 26 preferably has fill aperture 36 in a wall thereof. The fill aperture 36 can be located in any wall and in any wall location desired, but preferably is located near a bottom portion of the cleaning fluid reservoir 26 as shown in the figures. In highly preferred embodiments such as the illustrated embodiment, the fill aperture 36 can be opened and closed by a user, and more preferably is the same aperture through which cleaning fluid is removed from the cleaning fluid reservoir 26 during device operation. Although a number of elements can be used to open and close the fill aperture 36, a knob or dial is preferably fitted in, on, or about the fill aperture 36 and can be rotated to align (open) or misalign (close) apertures in the knob or dial with respect to spaced apertures at least partially defining the fill aperture 36. Preferably, the fill aperture is releasably engagable with a fluid port 54 located in the area where the cleaning fluid reservoir is received, such as in the above-described housing receptacle 34.

Figure 8:
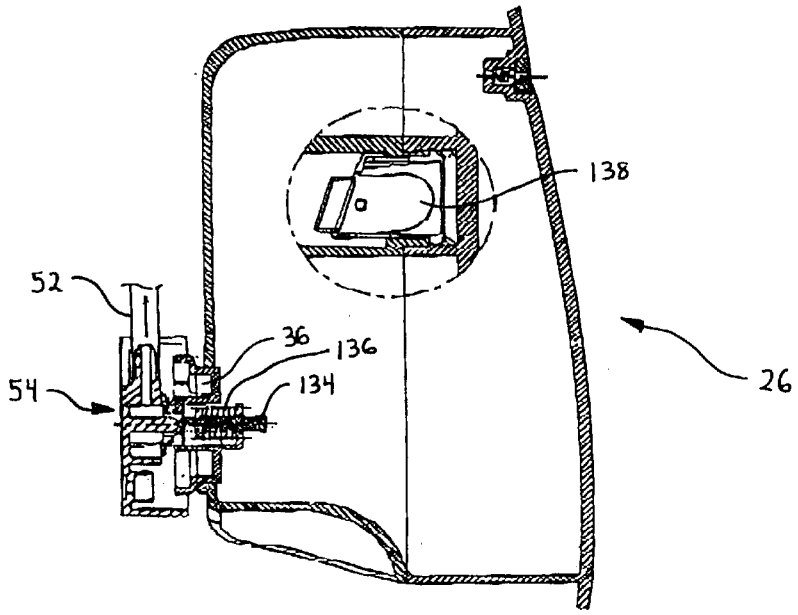
FIG. 8 is a detail view of the cleaning fluid reservoir fluid connection illustrated in FIG. 3.

The releasable connection between the fluid port 54 and the fill aperture 36 can take any conventional form, but more preferably employs a spring-loaded closing element as best shown in FIG. 8. Specifically, the fill aperture 36 preferably has a gasketed plug 134 that is movable in the fill aperture 36 to open and close the fill aperture 36. Preferably, a spring 136 is fitted upon the plug 134 and is retained between a wall or extension of the housing and a shoulder or gasket of the plug 134 to maintain the gasketed plug 134 in sealing engagement with the fill aperture 36. A pin, post, or other extension on the fluid port 54 preferably extends into contact with the plug 134 to push the plug 134 to an open position when the fill aperture 134 and the fluid port 54 are connected. In this manner, the fill aperture 36 preferably remains closed until the cleaning fluid reservoir 26 is installed in the vacuum cleaner and steamer 10, thereby causing the plug 134 in the fluid port 54 to open the fill aperture 36. It will be appreciated by one having ordinary skill in the art that many conventional fluid connectors can be used in place of the above-described fill aperture 36 and fluid port 54 connection, many of which establish fluid communication only upon mechanical connection of the connector.

Alternatively, the cleaning fluid reservoir 26 can have an fill aperture or door in a top wall thereof, wherein the fill aperture or door is preferably sealed against leakage by a gasket compressed between the cleaning fluid reservoir 26 and the housing receptacle 34 when the cleaning fluid reservoir 26 is inserted within its housing receptacle 34. One having ordinary skill in the art will appreciate that still other leak-resistant fill aperture types can be used for the cleaning fluid reservoir 26, some of which are the same apertures through which fluid is drawn from the cleaning fluid reservoir 26 during device operation and some of which are not.

It should be noted that the cleaning fluid reservoir 26 need not necessarily be removable from the vacuum cleaner and steamer 10, although such a feature is highly preferred for ease of reservoir filling. In those embodiments where the cleaning fluid reservoir 26 is not removable, the aperture used for filling the cleaning fluid reservoir is preferably different from the aperture connected to the fluid port 54, and is preferably located in a front, top, or side wall of the cleaning fluid reservoir 26 for purposes of user accessibility.

A wide variety of devices and configurations can be used to retain the cleaning fluid reservoir 26 in its receptacle. Most preferably, the cleaning fluid reservoir 26 has at least one retaining clip 138 having a hooked end that is releasably engagable with the housing 20, frame, or other structure of the body assembly 16. In the illustrated preferred embodiment, two retaining clips 138 flank the cleaning fluid reservoir 26 and releasably engage with lips or apertures in the edges of the recess 34 for the cleaning fluid reservoir. The retaining clip(s) 138 can be spring loaded in any conventional manner or can themselves be made from resilient deformable material such as spring steel, plastic, and the like. Preferably, by squeezing, gripping, or pressing the retaining clip(s) 138, the hooked ends move to disengage from the housing 20, frame, or other body assembly structure. One having ordinary skill in the art will appreciate that many different elements and devices can be used to releasably retain the cleaning fluid reservoir 26 in its receptacle, including without limitation one or more latches, clamps, clasps, catches, and the like. The various possible retaining elements and devices can be located on the cleaning fluid reservoir 26, on the body assembly 16 (e.g., retaining clips 138 instead located on the body assembly 16 and mating with apertures or lips on the cleaning fluid reservoir 26), or on both the cleaning fluid reservoir 26 and the body assembly 16. Depending upon the shape and relationship of the cleaning fluid reservoir 26 and its preferred recess 34 within the body assembly 16, the cleaning fluid reservoir 26 can even be retained in the recess 34 through a light interference fit.

Cleaning fluid can be drawn from any location on the cleaning fluid reservoir 26, and (as described above) can be drawn from the same or a different location than where cleaning fluid added to the cleaning fluid reservoir 26 by a user. In the illustrated preferred embodiment, cleaning fluid is drawn from the fill aperture 36 at a relatively low location on the cleaning fluid reservoir 26, particularly taking into account the tilted orientation of the vacuum cleaner and steamer 10 when in normal use. Particularly where cleaning fluid is drawn from the cleaning fluid reservoir at higher locations, the cleaning fluid reservoir 26 can be provided with a draw tube extending from a low position in the cleaning fluid reservoir 26 to the fluid port 54.

Upon system demand, cleaning fluid is preferably drawn from the cleaning fluid reservoir 26 via the fluid pump 28. The fluid pump 28 and its operation are conventional in nature and are not therefore described further herein. The fluid pump 28 can be mounted within the housing 20 in any conventional manner, such as by one or more brackets, standoffs, bosses, or mounting plates, by being secured directly to a wall of the housing 20 by one or more conventional fasteners, by being retained within a compartment of the housing 20 preferably shaped to prevent movement of the fluid pump 28 when installed in the housing 20, and the like. Where the vacuum cleaner and steamer has no housing 20, the fluid pump 28 is preferably mounted in any conventional manner to adjacent framework supporting or retaining the cleaning fluid reservoir 26 and/or the waste reservoir 74.

As mentioned above, the fluid pump 28 operates to pump cleaning fluid to the heater 30. The heater 30 can take many different forms well known to those skilled in the art, but most preferably has a heater housing 38 having one or more internal chambers 40 defining one or more fluid flow paths through the heater housing 38, a conventional electric heating element 42, and fluid input and output ports 44, 46, respectively. With continued reference to FIG. 4, the heater housing 38 most preferably has multiple flow paths therethrough, each of which has baffles, walls, or other flow obstructions 48 therein for diverting and slowing flow to result in greater opportunity for heat transfer to the cleaning fluid in the heater housing 38. The heater housing 38 can be defined by one element or by multiple elements assembled in any conventional manner. For example, the heater housing 38 shown in FIG. 4 includes a cover (not shown) secured over a main body portion of the heater housing 38.

The electric heating element 42 is preferably embedded within the heater housing 38 (such as by being cast or molded therein). Alternatively, the heating element 42 can be attached to the heater housing 38 in any conventional manner, including without limitation by brazing, welding, brackets, fasteners, and the like. Preferably, the heating element 42 runs adjacent to the flow paths through the heater housing 38, although any heating element shape and position within the heater housing 38 capable of causing cleaning fluid vaporization can be used.

The heater 30 shown in FIG. 4 is one of many different heater types that can be employed to generate cleaning fluid steam from liquid cleaning fluid entering the heater 30. For example, the heating element 42 can be sheathed and located within the heater housing 38 to be directly contacted by or immersed within cleaning fluid entering the heater 30. Other heater types are well known to those skilled in the art and fall within the spirit and scope of the present invention.

Upon exiting the heater 30, cleaning fluid is in the form of steam. This steam travels to the sprayer head 32 in the base assembly 18. The sprayer head 32 is conventional in nature, and preferably is elongated with a plurality of apertures 50 therein for permitting steam to escape the fluid assembly 12.

Fluid preferably travels between components of the fluid assembly 12 via flexible tubes. In particular, the fluid pump 28 preferably receives cleaning fluid from the cleaning fluid reservoir 26 via a flexible tube 52 connected to the port 54 in the housing recess 34 and to an inlet port 56 of the fluid pump 28. Similarly, the heater 30 preferably receives cleaning fluid from the fluid pump 28 via a flexible tube 58 connected to an outlet port 60 of the fluid pump 28 and to the inlet port 44 of the heater 30. Steam exiting the heater 30 preferably passes through two flexible tubes 62 each connected at one end to a respective outlet port 46 of the heater 30 and at an opposite end to a respective inlet port 64 of the sprayer head 32. Each of the connections for the flexible tubes 52, 58, 62 to their connected ports 54, 56, 60, 44, 46, and 64 is made in a conventional manner, such as by a slip-on interference fit, by compression fittings, by band clamps tightened about the tubes upon their ports, and the like.

The tubes 52, 58 upstream of the heater 30 are not subjected to significantly elevated temperatures in operation of the vacuum cleaner and steamer 10, and so can be made of any conventional plastic, nylon, or other flexible tubing material suitable at least for transporting cleaning solvents and detergents used for floor cleaning (e.g., carpet cleaner, tile cleaner, etc.). Because the flexible tubes 62 running from the heater 30 to the sprayer head 32 carry hot steam, these flexible tubes 62 are preferably made from a material suitable for transporting cleaning solvents and detergents and capable of withstanding elevated temperatures. Most preferably, these tubes 62 are made of silicon rubber, but can instead be made of other material well known to those skilled in the art.

It should be noted that flexible tubing is preferred to connect the cleaning fluid reservoir 26 to the fluid pump 28, the fluid pump 28 to the heater 30, and the heater 30 to the sprayer head 32, but is not required to practice the present invention. Any or all of these fluid connections can be made in any conventional manner for transporting fluid. For example, any or all of these fluid connections can be made via one or more pipes, metal fluid lines (e.g., copper tubing), and the like. These alternative fluid conduits can be connected to the cleaning fluid reservoir 26, fluid pump 28, heater 30, and sprayer head 32 in any conventional manner, such as by threaded fittings and joints, compression fittings, etc.

The arrangement and relative locations of the cleaning fluid reservoir 26, fluid pump 28, heater 30, and sprayer head 32 is preferably as shown in FIG. 3. However, these fluid assembly components can be arranged in a significantly different manner while still performing the same steam generating functions of the present invention. By way of example only, the fluid pump 28 need not necessarily be connected to the cleaning fluid reservoir 26 via a flexible tube 52 or other fluid conduit, and can instead be located immediately adjacent to the cleaning fluid reservoir 26 for direct connection thereto via a mating (and releasable) fluid connector of conventional design as described above with reference to the alternative connections between the fill aperture 36 of the cleaning fluid reservoir 26 and the fluid port 54. As another example, the fluid pump 28 and heater 30 can be located adjacent to one another and can be directly connected together via a conventional fluid connector without the need for flexible tubing 58. In less preferred embodiments of the present invention, the heater 30 can be located in the base assembly 18 for direct attachment to the sprayer head 32 without using flexible tubing 62 or using much shorter lengths of such tubing. This latter alternative embodiment is less preferred because it can undesirably increase the size of the base assembly 18. Any of the components of the fluid assembly 12 can be spaced closer together or farther apart as desired, dependent at least in part upon the shape of the housing 20, the available space within the housing 20, and the position of other elements in the body assembly 16 and the base assembly 18.

In the illustrated preferred embodiment of the present invention, a single fluid line connects the cleaning fluid reservoir 26 to the fluid pump 28 and the fluid pump 28 to the heater 30, while two fluid lines connect the heater 30 to the sprayer head 32. One having ordinary skill in the art will appreciate that the number of fluid lines connecting these fluid assembly components can vary significantly, such as two or more fluid lines connecting the cleaning fluid reservoir 26 to the fluid pump 28, or one, three, or more fluid lines connecting the heater 30 to the sprayer head 32. With regard to the fluid lines carrying steam away from the heater 30, it should be noted that alternative embodiments of the present invention can employ multiple sprayer heads 32 each supplied with steam from the heater 30 via one or more dedicated fluid lines. Such multiple sprayer heads 32 can be located and arranged in any number of positions and patterns on the base assembly 18 as desired. Similarly, the fluid assembly 12 can employ multiple heaters 30, fluid pumps 28, and/or cleaning fluid reservoirs 26 operating in a manner similar to the fluid assembly 12 of the preferred embodiment described above and illustrated in the figures.

The fluid assembly 12 preferably employs a powered fluid pump 28 for drawing cleaning fluid from the cleaning fluid reservoir 26 and supplying the heater 30 with such fluid. However, alternative embodiments of the present invention can employ a valve (not shown) located between the cleaning fluid reservoir 26 and the heater 30 for supplying only desired amounts or flow rates of cleaning fluid under gravity to the heater 30. It is therefore possible to entirely eliminate the use of the fluid pump 28 in the present invention and to instead rely upon the force of gravity for supplying the heater 30 with cleaning fluid. To properly draw cleaning fluid in such fluid assembly designs, the fluid connection to the cleaning fluid reservoir 26 is preferably made at a low position on the cleaning fluid reservoir 26 rather than at a relatively high location as shown in FIG. 3. Most preferably, this connection would be at the lowest possible location on the cleaning fluid reservoir 26.

The vacuum cleaner and steamer assembly 10 of the present invention preferably employs a cleaning fluid reservoir 26 for improved portability and maneuverability of the assembly. However, in less preferred embodiments of the present invention, the cleaning fluid reservoir 26 is eliminated in lieu of a fluid supply connection made between an external source of cleaning fluid and the fluid assembly 12. In such embodiments, cleaning fluid can be supplied directly to the fluid assembly 12 via any conventional fluid connector. This connector can be permanent, but more preferably is releasable by a user (e.g., a quick disconnect fluid coupling or like device). Where cleaning fluid is supplied under sufficient pressure to the fluid assembly 12, it is possible to eliminate the fluid pump 28 from the fluid assembly 12 and to employ a valve upstream of the heater 30 for supplying only desired amounts or flow rates of cleaning fluid to the heater 30. In still other embodiments of the present invention, the fluid assembly 12 described above and illustrated in FIGS. 3 and 4 can, in addition to having a cleaning fluid reservoir, include a conventional fluid connector located upstream or downstream of the fluid pump 28 for supplying the fluid assembly 12 with cleaning fluid from an external source. This connector can be used to fill the cleaning fluid reservoir 26 without the need to remove the cleaning fluid reservoir 26, to add in a different cleaning fluid or an additive for mixing with cleaning fluid from the cleaning fluid reservoir 26, as an alternative method for supplying cleaning fluid to the heater 30, and the like.

The vacuum assembly 14 of the present invention is operable to draw liquids, solids, or any combination thereof from a surface being cleaned. To this end, the present invention is operable as a wet/dry vacuum cleaner, and has a conventional electric motor 66 driveably connected to a fan 68 to generate a suction force through the vacuum assembly 14. The electric motor 66 and fan 68 can be mounted within the body assembly 16 in any conventional manner, such as by a mounting frame, a bracket assembly, and the like. Where the vacuum cleaner and steamer 10 has a housing 20, the motor 66 and fan 68 are preferably directly or indirectly mounted thereto in any conventional fashion. The motor 66 and fan 68 in the vacuum assembly are conventional in nature and are not therefore described further herein.

Figure 6:
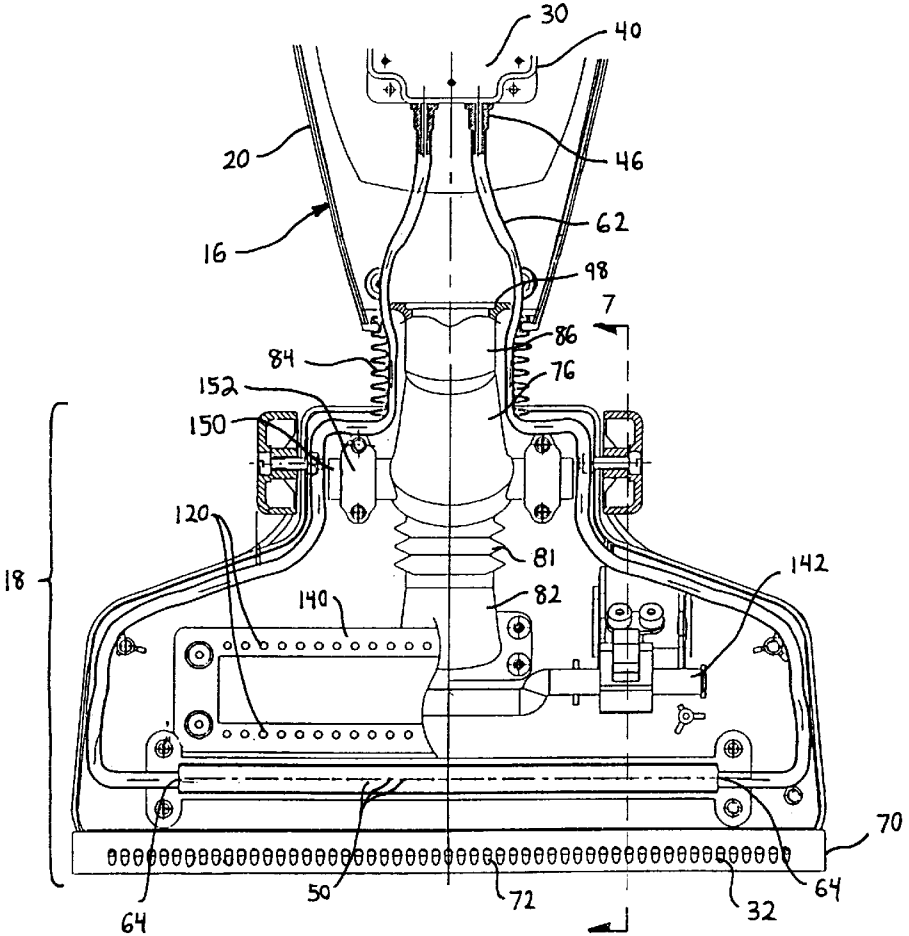
FIG. 6 is a plan view of the base of the vacuum cleaner and steamer apparatus illustrated in FIGS. 1–5.

Referring to FIGS. 3 and 6, the base assembly 18 includes a vacuum head 70 in fluid communication with the fan 68 to draw air, liquid, and debris into the vacuum assembly 14. The vacuum head 70 preferably has at least one input port 72 located at the bottom of the base assembly 18 and preferably substantially facing a surface upon which the base assembly 18 is placed. The input port(s) 72 can be any shape desired, but are preferably large enough to prevent clogging during normal vacuuming operations. Also, where multiple input ports 72 are used, the input ports 72 are preferably aligned in front of the sprayer head 32 as shown in the figures, although any other pattern or arrangement of multiple input ports 72 can instead be employed if desired.

The vacuum head 70 has a flow path therethrough preferably defined by a number of walls. Although the flow path can be defined by a number of substantially rigid or flexible walls or a rigid or flexible conduit connecting the input ports 72 directly to a waste reservoir 74 (described in more detail below) or to a throat leading to the waste reservoir 74, the flow path is more preferably defined by interior walls of the base assembly 18, and extends from the input ports 72 to a conduit 76 connected to and in fluid communication with the waste reservoir 74.

A highly preferred feature of the present invention is the ability of a user to maneuver the body assembly 16 with respect to the base assembly 18 for better control of the vacuum cleaner and steamer 10. Unlike conventional cleaners that are movable only as a single rigid element, the ability to move the body assembly 16 with respect to the base assembly 18 permits a user to move the base assembly 18 into many areas that could otherwise not be reached for cleaning, and provides significantly greater control over the vacuum cleaner and steamer 10 using considerably less maneuvering force. Therefore, although a jointed or hinged relationship between the base assembly 18 and the body assembly 16 is not required to practice the present invention, such a feature is highly preferred.

Any mechanical connection permitting at least limited rotational movement between the base assembly 18 and the body assembly 16 can be employed, including without limitation a hinge joint, a ball and socket joint, a pin and bushing joint, and the like. For purposes of structural strength, such connections are preferably made between the body of the base assembly 18 and the housing 20 of the body assembly 16. In the illustrated preferred embodiment for example, the body assembly 16 is rotatably connected to the body of the base assembly 18 via a pivot post 150 rotatably mounted within one or more bushings 152 secured to the base assembly 18 in any conventional manner (such as by one or more conventional fasteners as illustrated, by welding, brazing, clamping, gluing, and the like). The pivot post 150 can be connected to the housing 20 of the body assembly 16 by a frame, connecting rod, or other member (not shown) connected to the pivot post 150 at one end and to the housing 20 at another. Other manners of rotatably connecting the base assembly 18 to the body assembly 16 are well-known to those skilled in the art and fall within the spirit and scope of the present invention.

Preferably, the conduit 76 is movable with respect to the rest of the base assembly 18 in order to permit the base assembly 18 to move with respect to the body assembly 16. In the illustrated preferred embodiment, this relationship is enabled by one or more flexible tubes or ducts, or conduits 81 connected to the lower end of the conduit 76. The flexible tube 81 can be made of any flexible or semi-flexible material such as rubber, nylon, plastic, and the like. To enable additional flexibility, the tube 81 can be ribbed as shown in the figures, can have one or more joints or weakened areas, can be made of material that is sufficiently pliable to deform (preferably without buckling) when bent, etc. The flexible tube 81 preferably runs from the lower end of the conduit 76 to the walls within the base assembly 18 leading to the input ports 72, and can be connected in any conventional manner (including without limitation by hose clamps, elastomeric bands, one or more conventional fasteners, by a snap, light interference, or clearance fit, and the like). Preferably, the interior base assembly walls to which the flexible tube 81 is connected have a mouth 82 permitting easy connection of the flexible tube 81 thereto. However, the walls can be shaped and arranged in other manners for connection to the flexible tube 81, which itself can be any shape enabling such a connection. In this regard, any conventional connection between a flexible tube and a port defined by one or more walls can be employed for the tube connection in the base assembly 18. It should also be noted that the flexible tube 81 can be releasable or permanently connected as desired.

One having ordinary skill in the art will appreciate that other manners exist for maintaining fluid communication between the base assembly 18 and the body assembly 16 while permitting movement of the base assembly 18 relative to the body assembly 16, each of which falls within the spirit and scope of the present invention. By way of example only, such movement can be provided by connecting the conduit 76 to the base assembly 18 by a joint. Specifically, the lower end of conduit 76 can be received within a recess or receptacle within the base assembly 18 to define the joint. This joint can operate in much the same manner as a ball and socket joint. The lower end of the conduit 76 can be rounded, and can be laterally elongated or spherical as desired. Alternatively, the lower end of conduit 76 can form with the base assembly 18 a hinge-type joint (pivotable about a pivot connected to the lower end of the conduit 76 and to the base assembly 18 in any conventional manner, such as to one or more bosses extending from the base assembly 18 and through apertures in the lower end of the conduit 76). Still other manners of connecting the conduit 76 to the remainder of the base assembly 18 (with or without a recess in the base assembly 18) are possible.

Where a joint is employed such as the above-described ball and socket-type joint, the interior of the conduit 76 preferably maintains fluid communication with the flow path through the base assembly 18 in a range of relative positions between the conduit 76 and the rest of the base assembly 18. More preferably, fluid communication is maintained in all possible positions of the conduit 76 with respect to the rest of the base assembly 18. To enable fluid communication in either manner for such a connection between the base assembly 18 and the body assembly 16, the end of the conduit 76 is preferably at least partially open or has at least one aperture therein that remains aligned with the flow path through the base assembly 18 in movement of the conduit 76. For example, the flow path through the base assembly 18 can be a channel defined by interior walls of the base assembly 18, or can terminate in a chamber of any shape and size adjacent to the conduit 76 and also defined by interior walls of the base assembly 18. The channel or chamber preferably remains aligned with the open or apertured lower end of the conduit 76 in a range of conduit positions, and more preferably in all conduit positions. In this manner, the body assembly 16 can be moved with respect to the base assembly 18 without interrupting vacuuming operations. It should be noted that the aligned apertures in the base assembly 18 and in the conduit 76 can take any shape or form capable of maintaining fluid communication in different conduit positions. Also, multiple flow paths to the conduit 76 are possible for transmitting vacuum force through the joint.

It should be noted that some types of connections between the base assembly 18 and the conduit 76 can be strong enough to eliminate the need for a rotatable joint between the base assembly 18 and the body assembly 16 as described above. In such cases, the strength and flexibility of the conduit 76 is sufficient to connect the base assembly 18 to the body assembly 16 while maintaining the desired flexibility therebetween.

In less preferred embodiments, the base assembly 18 is not movable with respect to the body assembly. In such cases, there is less need for flexible tubes 62 to connect the heater 30 with the sprayer head 32, thereby permitting the use of different types of conventional tubing, piping, or conduit to connect these elements. Also in such a case, the base assembly 18 can be and preferably is angled slightly with respect to the body assembly 16 (i.e., the body assembly 16 leaning slightly to the rear when the base assembly 18 is placed upon a surface to be cleaned) to provide greater user comfort and maneuverability of the vacuum cleaner and steamer 10.

If desired, the connection (jointed or otherwise) between the base assembly 18 and the body assembly 16 can be enclosed in a boot 84 made of any flexible or rigid material desired. Preferably, the boot 84 is made of a flexible rubber or plastic material and encloses the conduit 76, flexible tubes 62, and any structural connecting rod(s) connected to the pivot post 150 and to the body assembly 16.

The conduit 76 extending from the base assembly 18 is directly or indirectly connected to the waste reservoir 74. In the preferred embodiment illustrated in the figures, the conduit 76 is connected to a port duct 86 extending from the conduit 76 to the housing 20 to which it is attached and sealed with a fluid tight seal in a conventional manner, such as by adhesive, welding, brazing, bonding, clamping, fastening with conventional fasteners, and the like. As an alternative, the conduit 76 can itself extend to and be connected to the housing 20 is a similar manner. Where no housing 20 is employed, the port duct 86 or the conduit 76 can mate (preferably releasably) via a fluid tight seal directly to the waste reservoir 74.

As mentioned above, the waste reservoir 74 of the present invention is preferably removable from the body assembly 16. Like the cleaning fluid reservoir 26, the waste reservoir 74 is preferably transparent or semi-transparent to permit a user to at least see how full the waste reservoir 74 is and also preferably to see the type and amount of waste being vacuumed by the vacuum assembly 14. The waste reservoir 74 is preferably made from plastic (and less preferably, glass), but can instead be made from any other rigid or substantially rigid material, including without limitation aluminum, steel, or other metal, fiberglass, composites, and the like. The waste reservoir 74 can also take any shape desired such as those described above with reference to the cleaning fluid reservoir 26.

Like the cleaning fluid reservoir 26, the waste reservoir 74 is preferably received at least partially within the body assembly 16 and more preferably within a similarly shaped receptacle in the housing 20 of the body assembly 16. For example, the waste reservoir 74 illustrated in FIGS. 1–3 has an unusual shape matching a recess or receptacle 92 within the housing 20. While a matching reservoir and receptacle are not required, the waste reservoir 74 is preferably received in the housing 20 in a secure manner to be held therein after insertion. Also, the housing receptacle 92 for the waste reservoir 74 can take the form of an externally-exposed recess as shown in the figures or can be partially or fully enclosed (e.g., by one or more doors or panels hinged or otherwise movable between an open position in which the waste reservoir 74 can be removed from the housing 20 and a closed position in which the waste reservoir 74 is retained within the housing 20).

Preferably, the waste reservoir 74 is provided with a handle 88 to facilitate easier removal, carrying, and installation of the waste reservoir 74. The handle 88 can take any form desired, such as a closed loop as shown in the figures, a lip or overhang, a graspable protrusion extending from the body of the waste reservoir 74, and the like. The body of the waste reservoir itself can even be shaped to be readily grasped by a user. In the illustrated preferred embodiment, the handle 88 is a separate element connected to the waste reservoir in any conventional manner (e.g., via fasteners as shown, gluing, clamping, welding, brazing, press-fitting, snap-fitting, etc.), but can instead be integral with the waste reservoir 74 if desired.

In those embodiments of the present invention employing a removable waste reservoir 74, the waste reservoir 74 can be retained in the vacuum cleaner and steamer 10 (and most preferably, in the housing receptacle 92) in any of the manners described above for retaining the cleaning fluid reservoir 26 in its position in the vacuum cleaner and steamer 10. Most preferably however, the waste reservoir 74 is retained in the housing receptacle 92 by a flexible clip 90 interacting with a portion of the body assembly 16. The clip 90 can be a separate part attached to the waste reservoir 74 in any conventional manner such as by welding, press or snap fitting, fastening with conventional fastener(s), gluing, and the like, and is preferably made of a resilient flexible material such as spring steel, plastic, etc. Most preferably however, the clip 90 is integral with the body of the waste reservoir 74, and is flexible to releasably engage with the housing via a recess and detent relationship.

It may be desirable to establish fluid-tight connections between the waste reservoir 74 and the conduit 76 (or port duct 86) and the fan 68. To this end, gaskets of conventional form can be used to seal the conduit 76 (or port duct 86) to an input port 98 of the waste reservoir 74 and the fan 68 to an output duct 100 of the waste reservoir 74. One such gasket 96 is shown in the illustrated preferred embodiment between the output duct 100 of the waste reservoir 74 and the fan 68. In highly preferred embodiments of the present invention, the gaskets sealing the waste reservoir 74 are conventional 0-ring gaskets attached to the waste reservoir 74 at their points of vacuum connection, but can instead be any other gasket type connected to the waste reservoir 74, to the conduit 76 (or port duct 86) and/or to the output duct 100 at their points of vacuum connection. Most preferably, these gaskets provide a tight fit of the waste reservoir 74 in the body assembly 16 while still permitting removal and replacement of the waste reservoir 74.

To permit easy emptying of the waste reservoir 74, the waste reservoir 74 can be provided with a door (not shown) removable, hinged, slidable, or otherwise openable with respect to adjacent walls of the waste reservoir 74. The door can be located at any position on the waste reservoir 74, but is most preferably located at the top of the waste reservoir 74. Depending upon the location of the door 88, the door 88 can be openable when the waste reservoir 74 is installed in the body assembly 16 or can be openable only after removal of the waste reservoir 74. A door gasket in the form of an 0-ring or any other conventional gasket can be employed to establish a fluid-tight seal of the door on the waste reservoir 74 when closed.

During operation of the fluid assembly 12, the heating element 42 can generate significant heat. Elements surrounding the heater 30 are preferably shielded from this heat by one or more heat shields. In the particular configuration illustrated in the figures, the heater 30 is located near the waste reservoir 74. Accordingly, a heat shield 102 (acting as a heat reflector and/or heat sink) is preferably mounted in any conventional fashion within the body assembly 16 between the heater 30 and the waste reservoir 74. The heat shield 102 can be made of any heat insulative material such as ceramic, fiberglass, high-temperature plastic, and the like, but most preferably is made of aluminum.

The waste reservoir 74 can have any internal structure desired, but-is preferably adapted for separating air from liquid and solid matter being drawn into the waste reservoir 74. To perform this function, the waste reservoir 74 preferably has an internal conduit 104 running from the input port 98 to a location inside the waste reservoir 74 and a diverting wall 106 located at or near the end of the internal conduit 104 opposite the input port 98. Liquid, dust, soil, debris, and other matter entering the waste reservoir 74 therefore travel through the internal conduit 104, are diverted by the diverting wall 106, and fall to the bottom of the waste reservoir 74 while air continues to travel around the diverting wall 106 and out of the waste reservoir 74 via the output duct 100. It should be noted that the diverting wall 106 can be flat, curved, or can take any other shape functioning to divert the flow of matter entering the waste reservoir 74 from an upward trajectory. The diverting wall 106 can extend from any wall of the waste reservoir 74 as best shown in FIG. 3 and can even extend from the end of the internal conduit 104 if desired.

To prevent dust and other matter from exiting the waste reservoir 74 with the flow of air, the output duct 100 is preferably fitted with a conventional air filter 108 covering the output duct. The air filter 108 can be held in place over the output duct 100 or other exit of the waste reservoir 74 by a seat defined in the output duct 100 or exit, by a screen, grating, or perforated plate covering the output duct 100 or exit, by one or more conventional fasteners or clips holding the air filter 108 in place over the duct 100 or exit, etc. The air filter 108 can instead be retained at the intake of the fan 68 in any such manner.

After exiting the waste reservoir 74 through the air filter 108, air preferably passes through the fan 68 and is discharged from the body assembly 16 (and more preferably, is discharged from the housing 20 of the body assembly 16 through one or more vent apertures 110 therein).

Figure 9:
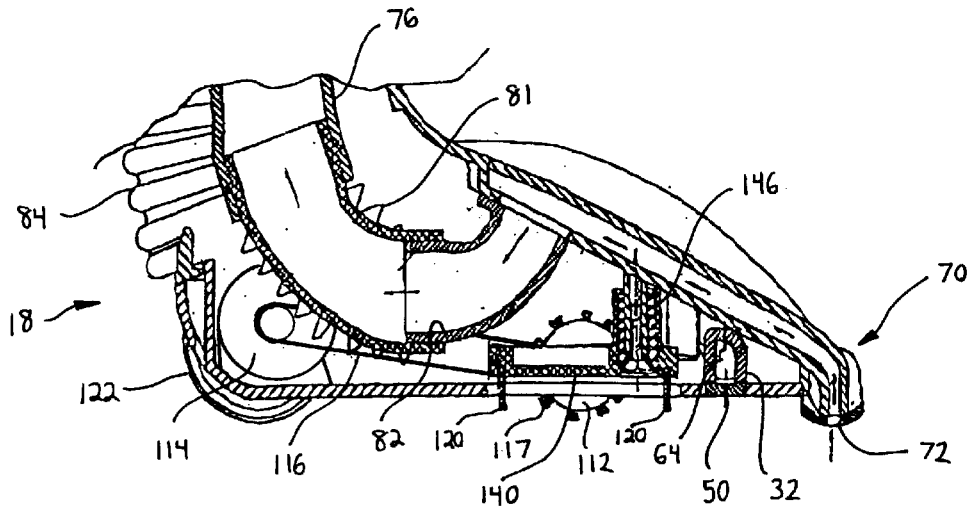
FIG. 9 is a detail view of the base of the vacuum cleaner and steamer apparatus illustrated in FIG. 3.

Some highly preferred embodiments of the present invention can employ an agitator for assisting in steam cleaning and/or vacuuming operations. This agitator can take a number of different forms, such as a plurality of pads, bumps, or bristles mounted on a reciprocating member driven by an electric motor, one or more rotating discs having such elements thereon and driven to spin by an electric motor, and the like. Most preferably however, the agitator is a rotary brush 112 (shown only in FIG. 9) mounted upon one or more pivots which are themselves mounted for rotation in the base assembly 18 in any conventional manner (e.g., received within sockets in the internal walls of the base assembly 18, rotatably supported by one or more bosses or brackets secured inside the base assembly 18, etc.). Preferably, the rotary brush 112 is driven by a belt 116 which is driven in a conventional manner by an electric motor 114 (also shown only in FIG. 9) located within the base assembly 18. Although such a driving connection is preferred, one having ordinary skill in the art will appreciate that the rotary brush 112 can be driveably connected to the electric motor 114 in a number of other manners, including without limitation by a gear set, by a sprocket and chain assembly, by being directly connected to the output shaft of the electric motor 114, and the like. Such alternative manners of driving the rotary brush 112 via the electric motor 114 fall within the spirit and scope of the present invention.

The electric motor 114 can be powered by the same source of power as the fan motor 66 in the body assembly 16, such as AC power supplied to the vacuum cleaner and steamer 10 via a power cord (not shown). More preferably, however, the electric motor 114 is a DC motor driven by direct current power from a conventional electrical transformer (also not shown) located in the base assembly 18 or in the body assembly 16. The electrical transformer preferably transforms alternating current power such as that supplied to the fan motor 66 to direct current power for the rotary brush motor 114. In less preferred embodiments of the present invention, either or both motors 66, 114 are DC motors powered by one or more single-use or rechargeable batteries.

With reference to FIG. 6, the rotary brush 112 preferably has a plurality of bristles 117 arranged upon the rotary brush 112 in any desired fashion. Most preferably however, the bristles 117 are arranged in one or more helixes about the circumference of the rotary brush 112 as shown by way of example in FIG. 6. As an alternative to bristles, one or more raised pads, bumps, posts, or other elements extending from the roll surface can be used for agitating the surface being cleaned. These elements can be made of any desired material, but preferably are made from a resilient deformable material such as rubber, urethane, and the like.

The rotary brush 112 can be automatically driven at all times during steam cleaning and/or vacuuming operations of the present invention, but more preferably can be turned on and off by the user as desired. The control for turning the rotary brush 112 on or off can be a button, knob, lever, or other user-manipulatable device located on the handle portion 22 or on another location of the housing 20 or base assembly 18. However, this control is more preferably in the form of a lever 118 located on the base assembly 18 and operable by a the foot of a user. The lever 118 is preferably electrically coupled to the rotary brush motor 114 in any conventional manner.

Figure 5:
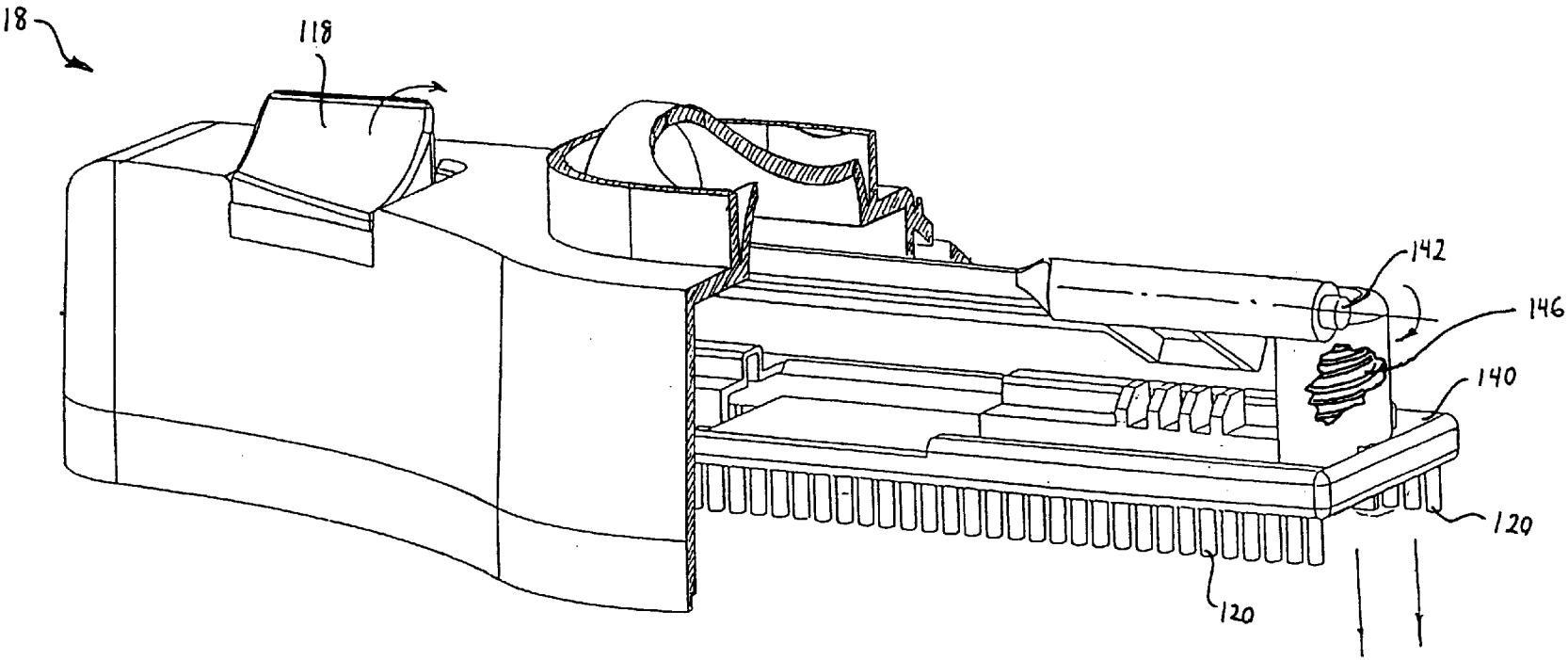
FIG. 5 is a perspective view, partially sectioned, of a portion of the base of the vacuum cleaner and steamer apparatus illustrated in FIGS. 1–4.
Figure 7:
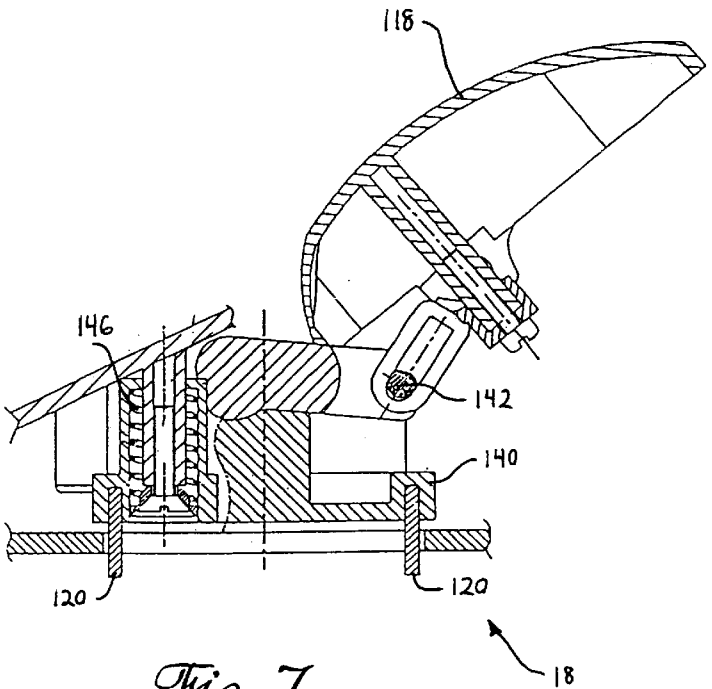
FIG. 7 is a cross sectional detail view of the base of the vacuum cleaner and steamer apparatus illustrated in FIG. 6, taken along lines 7—7 in FIG. 6.

It is often desirable to adjust the exposure of the surface being cleaned to the rotary brush 112. For example, a user may wish to lower exposure of the rotary brush 112 when cleaning wood-or tile floors, and to increase exposure of the rotary brush 112 when cleaning carpets or rugs. The present invention provides for such adjustment via an adjustable brush barrier 120 as best shown in FIG. 5. The brush barrier 120 can take any number of different forms, such as one or more flexible walls, a series of bristles, posts, pins, or other elongated elements, and the like. The elements forming the brush barrier 120 can surround the rotary brush 112, can be located in front of, behind, or both in front of and behind the rotary brush 112, or in any other location preferably adjacent to the rotary brush 112. Also, the elements forming the brush barrier 120 are preferably attached to or are integral with a brush barrier mount 140 in the base assembly 18. The brush barrier mount 140 is preferably at least vertically movable in the base assembly 18 to move the brush barrier 120 down or up beside the rotary brush 112, thereby adjusting the exposure of the rotary brush 112.

The brush barrier mount 140 can be vertically adjusted in a number of different manners, such as by one or more vertical threaded rods connected to the rotary brush and rotatable by the user to push or pull the brush barrier in a vertical direction, by one or more posts along which the brush barrier mount 140 is vertically movable, and the like. Most preferably, the brush barrier mount 140 is vertically adjustable by being rotatably connected to a shaft 142 mounted in any conventional manner for rotation in the housing of the base assembly 18. The shaft 142 preferably has a bent portion (not co-axial with the remainder of the shaft 142) in contact with the brush barrier mount 140 and/or to which the brush barrier mount 140 is connected, whereby rotation of the shaft 142 about its axis moves the brush barrier mount 140 vertically. Rotation of the shaft 142 can be via a knob, dial, handle, or other element connected to the shaft 142 in any conventional manner, but is most preferably by the foot pedal 118 located on the base assembly 118. The foot pedal 118 can be connected in any manner to rotate the shaft 142 about its axis, but most preferably is movable to cam against the shaft 142 for rotating the shaft 142. Preferably, the brush barrier mount 140 is biased into its lowered position by one or more springs 146 mounted thereon. Alternatively, the brush barrier mount 140 can be biased in its raised position by one or more springs (such as extension springs rather than compression springs in the illustrated preferred embodiment).

The barrier mount 140, brush barrier 120, shaft 142, and associated structure for adjustably positioning the brush barrier 120 in two or more positions are conventional in nature, operate in a manner well-known to those skilled in the art, and are not therefore described further herein. Many other conventional devices and elements can be employed that perform the same or similar functions, each one of which falls within the spirit and scope of the present invention.

Referring again to FIG. 6, it will be appreciated by one having ordinary skill in the art that the arrangement of the vacuum head 70, sprayer head 32 and rotary brush 112 can be different than that illustrated. Because steam cleaning operations are more easily preformed by pulling (rather than pushing) the vacuum cleaner and steamer 10 across a surface being cleaned, a sprayer head 32 located in the base assembly 18 behind the vacuum head 70 is preferred as illustrated in FIG. 6. However, the relative locations of these base assembly elements can be reversed. Similarly, the arrangement and relative locations of the rotary brush 112 with respect to the vacuum and sprayer heads 70, 32 can be changed as desired, as well as the number and locations of the base assembly wheels 122.

The vacuum cleaner and steamer 10 of the present invention preferably provides the user with control over various device operations. With reference to FIGS. 1–3, the vacuum steamer and cleaner 10 preferably has a set of controls conveniently located on the handle portion 22 (although any or all of these controls can be located elsewhere on the body or base assemblies 16, 18). The vacuum steamer and cleaner 10 includes a power switch 124 connected directly or indirectly to the fluid pump 28, heater 30, and motor 66. The vacuum steamer and cleaner 10 can also have a power light 148 indicating when power is supplied to the heater 30 and/or the motor 66 of the vacuum cleaner and steamer 10. Specifically, the power switch 124 can be connected directly to these elements for turning them on or off, but more preferably is connected to these elements via a set of electrical controls 125 (such as in the form of a conventional control board). The electrical controls 125 are conventional in nature and can be microprocessor based or be defined by discrete elements and logic circuitry. The power switch 124 is preferably a three-position rocker switch as described in more detail below, but can take any form of user-manipulatable control desired, including without limitation one or more switches of another type, levers, knobs, buttons, dials, and the like coupled in any conventional manner to the electrical controls 125. The vacuum steamer and cleaner 10 can also have a power light 148 indicating when power is supplied to the heater 30 and/or the motor 66 of the vacuum cleaner and steamer 10.

The power switch 124 preferably has three positions: a first position in which power is supplied to the fluid pump 28 and heater 30 for steam cleaning operations, a second position in which power is instead supplied to the vacuum motor 66 for vacuum cleaning operations, and a third position in which the vacuum cleaner and steamer 10 is off. Preferably, a steam indicator light 126 is provided and lights to indicate to the user when the vacuum cleaner and steamer 10 is in its steam cleaning mode. In alternate embodiments of the present invention, the power switch 124 can instead have an off position and one of the above-described power positions, or can instead or additionally have another position in which power is supplied to the fluid pump 28, heater 30, and vacuum motor 66 for simultaneous vacuum and steam cleaning operations. In short, any number and combination of power switch states can be employed in various embodiments of the present invention to supply power to the fluid pump 28, the heater 30, and/or the vacuum motor 66 as desired.

Another preferred feature of the present invention is the ability to control the amount of steam generated during steam cleaning operations. This capability is preferably provided by a user-manipulatable control electrically coupled to the fluid pump 28 (or to the valve controlling cleaning fluid flow to the heater 30 where no fluid pump 28 is used). This control can be in the form of a lever, button, plunger, or other element, but is preferably a dial or knob 128 as shown in FIGS. 1–3. The dial or knob 128 is preferably coupled to the fluid pump 28 to change the fluid pump operating speed in a conventional manner. Where a fluid valve is instead used, the dial or knob 128 is preferably coupled to the valve to change the extent to which the valve is open or to control how long the valve remains open when cycling between open and closed positions. In either case, the user is able to control how much cleaning fluid is released to the heater 30, and can thereby control how much steam is generated during steam cleaning operations.

Yet another preferred feature of the present invention is the ability of a user to monitor or detect the wetness of a surface being cleaned. The ability to detect surface wetness avoids the need for a user to continually check the surface to determine whether continued vacuuming is needed for drying the surface. Preferably, the vacuum cleaner and steamer 10 has at least one humidity sensor 130 mounted within the vacuum assembly 14 to detect the humidity of airflow in the vacuum assembly 14. The humidity sensor 130 is conventional in construction and operation, and is preferably mounted immediately upstream of the air filter 108 covering the airflow outlet from the waste reservoir 74. The humidity sensor 130 can be mounted to a wall of the output duct 100, can be located farther into the flow of air out of the waste reservoir 74, or can be located upstream or downstream of the waste reservoir output duct 100. In less preferred embodiments of the present invention, the humidity sensor 130 is located in the internal conduit 104 of the waste reservoir 74 or on an upper internal wall of the waste reservoir 74, in the conduit 76 or port duct 86 leading to the waste reservoir 74, or in the vacuum flow path through the base assembly 18. The humidity sensor 130 is preferably coupled to a humidity indicator light 132 to indicate to the user (preferably when the light is lit) that the surface being cleaned is still wet. In this manner, the user does not need to repeatedly check the surface to determine whether more vacuuming is needed to sufficiently dry the surface.

In operation of the present invention, the user preferably removes the cleaning fluid reservoir 26 for filling at least partially with cleaning fluid, or otherwise fills the cleaning fluid reservoir 26 while in the body assembly 16. After replacing the cleaning fluid reservoir 26 in its receptacle or recess 34, the user can turn the power switch 124 to the steam cleaning position, wherein the steam indicator light 126 is lit, fluid is drawn from the cleaning fluid reservoir 26 by the fluid pump 28 and is pumped to the heater 30, and steam is thereafter generated within the heater 30. The steam exits the sprayer head 32 and is thereby deposited upon the surface to be cleaned. If desired, the user can activate the rotary brush 112 via the rotary brush control switch 118 to agitate the steamed surface. The user can also adjust the steam output from the sprayer head 32 by adjusting the steam adjustment dial or knob 128.

After the surface has been steam cleaned to the satisfaction of the user by moving the base assembly 18 across the surface, the user can switch the power switch 124 to its vacuum cleaning position, wherein the vacuum motor 66 is powered to drive the fan 68 and to generate vacuum force through the vacuum head 70 in the base assembly 18. Fluid, dirt, soil, dust, and other debris are thereby drawn up into the vacuum head 70 and into the waste reservoir 74, where the air is then separated from liquids and solids in the vacuum flow. As the liquids and solids settle to the bottom of the waste reservoir 74, the air exits the waste reservoir 74 through the air filter 108 and then exits the vacuum cleaner and steamer 10 via the vent apertures 110 in the housing 20. Preferably, the user monitors the humidity indicator light 132 which remains lit until the surface being vacuumed becomes sufficiently dry (at which point the humidity indicator light 132 preferably turns off). When cleaning is complete, the user can turn the power switch 124 to its off position, and preferably removes the waste reservoir 74 from its receptacle or recess 92. The user then empties the waste reservoir 74, and returns the waste reservoir 74 to its receptacle or recess 92.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

It should be noted that throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical or electrical communication with another element. Examples include directly securing one element to another (e.g., via welding, bolting, gluing, mating, etc.), elements which can act upon one another (e.g., via camming, pushing, or other interaction) and one element imparting motion directly or through one or more other elements to another element. Also, the term "vacuum line" as used herein and in the appended claims refers to any portion or all of the flow path through the vacuum assembly 14—from the apertures 50 of the vacuum head 70 to the vent apertures 110 downstream of the vacuum fan 68.

We claim:

1. A vacuum cleaner and steamer apparatus, comprising:

a housing;

a cleaning fluid reservoir coupled to the housing;

a waste reservoir coupled to the housing, the cleaning fluid reservoir and the waste reservoir being removable from the housing;

a base mounted to the housing for movement therewith, the base having:

a vacuum head defining at least one vacuum inlet in fluid communication with the waste reservoir;

a sprayer head defining at least one fluid outlet in fluid communication with the cleaning fluid reservoir; and a heater coupled between the cleaning fluid reservoir and the sprayer head, the heater in fluid communication with the removable cleaning fluid reservoir to receive cleaning fluid from the cleaning fluid reservoir and to generate steam.

2. The apparatus as claimed in claim 1, further comprising a pump coupled between the cleaning fluid reservoir and the heater for pumping cleaning fluid from the cleaning fluid reservoir to the heater.

3. The apparatus as claimed in claim 2, further comprising a user-manipulatable control coupled to the pump, the pump having an operating speed controllable via the user-manipulatable control.

4. The apparatus as claimed in claim 1, wherein the base is movable with respect to the housing.

5. The apparatus as claimed in claim 4, wherein the base is movable with respect to the housing via a flexible conduit maintaining fluid communication between the waste reservoir and the vacuum head.

6. The apparatus as claimed in claim 1, further comprising:

a vacuum line running from the vacuum head to the waste reservoir; and a gasket releasably sealing the waste reservoir to the vacuum line.

7. The apparatus as claimed in claim 1, wherein the base further comprising a brush and a motor, the brush mounted for rotation and driven by the motor, and a barrier extendable and retractable adjacent to the brush to reduce and increase exposure of the brush, respectively.

8. The apparatus as claimed in claim 7, wherein the barrier is vertically adjustable to adjust the exposure of the brush.

9. The apparatus as claimed in claim 7, further comprising a foot pedal on the base and coupled to the barrier, wherein the barrier is adjustable via the foot pedal.

10. The apparatus as claimed in claim 1, further comprising:

at least one air discharge port for discharge of air drawn from the waste reservoir;

a flow path extending from the vacuum head to the at least one air outlet; and a humidity sensor in the airflow path.

11. The apparatus as claimed in claim 10, wherein the waste reservoir has an air outlet in fluid communication with the air discharge port, the apparatus further comprising a filter covering the air outlet, the humidity sensor located upstream of the filter.

12. The apparatus as claimed in claim 1, further comprising:

a motor;

a fan coupled to and driven by the motor for generating suction force through the waste reservoir;

a pump coupled to and between the cleaning fluid reservoir and the heater for pumping cleaning fluid from the cleaning fluid reservoir to the heater; and a user-manipulatable control electrically coupled to the motor, the heater, and the pump, the control having a first state in which the motor is powered to drive the fan for vacuuming operations, a second state in which the pump is powered to pump water to the heater for steam cleaning operations, and a third state in which the motor, pump, and heater are not powered.

13. A vacuum cleaner and steamer apparatus for cleaning a surface, comprising:

a body assembly defined at least partially by a removable cleaning fluid reservoir;

a heater in fluid communication with the cleaning fluid reservoir for generating steam from cleaning fluid received from the cleaning fluid reservoir; and a waste reservoir;

a base pivotably coupled to the body assembly, the base having:

a steam spray head coupled to and in fluid communication with the heater for discharging steam received from the heater to the surface; and a suction head coupled to and in fluid communication with the waste reservoir.

14. The apparatus as claimed in claim 13, further comprising a pump coupled to the removable cleaning fluid reservoir and to the heater for pumping cleaning fluid from the removable cleaning fluid reservoir to the heater.

15. The apparatus as claimed in claim 14, further comprising a user-manipulatable steam control coupled to the pump, the pump having a pumping speed controllable by the user-manipulatable steam control.

16. The apparatus as claimed in claim 13, wherein the body assembly further includes a housing within which is at least partially received the removable cleaning fluid reservoir.

17. The apparatus as claimed in claim 13, wherein the body assembly further includes a housing within which is at least partially received the waste reservoir.

18. The apparatus as claimed in claim 17, wherein the removable cleaning fluid reservoir is at least partially received within the housing.

19. The apparatus as claimed in claim 13, wherein the base is pivotably coupled to the body assembly via a hinge joint.

20. The apparatus as claimed in claim 13, further comprising a flexible conduit establishing fluid communication between the base and the waste reservoir.

21. The apparatus as claimed in claim 13, wherein the waste reservoir is removable.

22. The apparatus as claimed in claim 21, wherein the waste reservoir has a handle.

23. The apparatus as claimed in claim 13, wherein the body assembly further includes:

a housing; and a gasket compressed between the waste reservoir and the housing to seal the waste reservoir in the housing.

24. The apparatus as claimed in claim 13, wherein the base further comprises:

a motor; and a cleaning brush coupled to and driven by the motor.

25. The apparatus as claimed in claim 24, further comprising a barrier extendable and retractable adjacent to the cleaning brush to reduce and increase exposure of the cleaning brush, respectively.

26. The apparatus as claimed in claim 25, further comprising a foot pedal on the base, wherein the barrier is adjustable by a foot pedal to change the exposure of the cleaning brush.

27. The apparatus as claimed in claim 13, wherein the waste reservoir has an air outlet, the assembly further comprising a filter covering the air outlet.

28. The apparatus as claimed in claim 13, further comprising a humidity sensor positioned to detect humidity of air received in the assembly through the suction head.

29. The apparatus as claimed in claim 28, further comprising an indicator light coupled to the humidity sensor for indicating the humidity of air received in the assembly through the suction head.

30. The apparatus as claimed in claim 14, further comprising a motor;

a fan coupled to and driven by the motor for generating suction force through the waste reservoir; and a user-manipulatable control electrically coupled to the motor, the heater, and the pump, the control having a first state in which the motor is powered to drive the fan for vacuuming operations, a second state in which the pump is powered to pump water to the heater for steam cleaning operations, and a third state in which the motor, pump, and heater are not powered.

31. A vacuum cleaner and steamer apparatus, comprising:

a housing;

a cleaning fluid reservoir coupled to the housing;

a waste reservoir coupled to the housing, the cleaning fluid reservoir and the waste being reservoir removable from the housing, the waste reservoir having an inlet through which vacuumed matter is received into the waste reservoir and an outlet through which air exits from the waste reservoir;

an air filter covering the outlet of the waste reservoir;

a base coupled to the housing, the base having:

a vacuum head defining at least one vacuum inlet in fluid communication with the waste reservoir;

a sprayer head defining at least one fluid outlet in fluid communication with the cleaning fluid reservoir; and a heater coupled between the cleaning fluid reservoir and the sprayer head, the heater in fluid communication with the cleaning fluid reservoir to receive cleaning fluid from the cleaning fluid reservoir and to generate steam.

32. A vacuum cleaner and steamer apparatus, comprising:

a housing;

a cleaning fluid reservoir coupled to the housing;

a waste reservoir coupled to the housing, the cleaning fluid reservoir and the waste reservoir being removable from the housing;

a base coupled to the housing, the base having:

a vacuum head defining at least one vacuum inlet in fluid communication with the waste reservoir;

a sprayer head defining at least one fluid outlet in fluid communication with the cleaning fluid reservoir;

a motor;

a brush coupled to and driven by the motor; and a heater coupled between the cleaning fluid reservoir and the sprayer head, the heater in fluid communication with the cleaning fluid reservoir to receive cleaning fluid from the cleaning fluid reservoir and to generate steam.

* * * * *